US009951587B2

(12) United States Patent
Wood et al.

(10) Patent No.: US 9,951,587 B2
(45) Date of Patent: Apr. 24, 2018

(54) ELECTRONICALLY-ACTIVATED LINER HANGERS AND METHODS OF SETTING SAME IN WELLBORE

(71) Applicants: Edward T. Wood, Kingwood, TX (US); Aubrey Clifton Mills, Magnolia, TX (US)

(72) Inventors: Edward T. Wood, Kingwood, TX (US); Aubrey Clifton Mills, Magnolia, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 248 days.

(21) Appl. No.: 14/547,751

(22) Filed: Nov. 19, 2014

(65) Prior Publication Data

US 2016/0138373 A1 May 19, 2016

(51) Int. Cl.
*E21B 43/10* (2006.01)
*E21B 33/04* (2006.01)

(52) U.S. Cl.
CPC ..... *E21B 43/10* (2013.01); *E21B 33/0422* (2013.01); *E21B 43/103* (2013.01); *E21B 43/105* (2013.01)

(58) Field of Classification Search
CPC ..... E21B 43/10; E21B 43/103; E21B 43/105; E21B 33/0422
See application file for complete search history.

(56) References Cited

U.S. PATENT DOCUMENTS

| | | | | |
|---|---|---|---|---|
| 2009/0272544 | A1 | 11/2009 | Giroux et al. | |
| 2010/0243277 | A1 | 9/2010 | Ring | |
| 2011/0168408 | A1 | 7/2011 | Watson | |
| 2012/0241171 | A1 | 9/2012 | Srinivasan et al. | |
| 2013/0048308 | A1 | 2/2013 | Lehr et al. | |
| 2014/0008083 | A1* | 1/2014 | Ring | E21B 23/06 166/382 |
| 2015/0136394 | A1* | 5/2015 | Turley | E21B 43/10 166/285 |

OTHER PUBLICATIONS

PCT International Search Report; International Application No. PCT/US2015/060998; International Filing Date: Nov. 17, 2015; pp. 1-5.

* cited by examiner

*Primary Examiner* — Brad Harcourt
(74) *Attorney, Agent, or Firm* — Cantor Colburn LLP

(57) ABSTRACT

A method of hanging a liner in a wellbore is disclosed that in one non-limiting embodiment includes: conveying a liner having a liner hanger and a liner hanger actuator into the wellbore by a service string that includes controller that determines a downhole parameter of interest relating to setting of the liner hanger; determining by the controller the parameter of interest relating to setting of the liner hanger in the wellbore; and sending a wireless liner hanger command signal from the controller in response to the determined parameter of interest to cause the liner hanger actuator to set the liner hanger in the wellbore.

18 Claims, 3 Drawing Sheets

ELECTRONICALLY-ACTIVATED LINER HANGERS AND METHODS OF SETTING SAME IN WELLBORE

BACKGROUND

1. Field of the Disclosure

This disclosure relates generally to a liner hanger system and methods of setting the same in wellbores.

2. Background of the Art

Wellbores (also referred to as wells or boreholes) are drilled in subsurface formations for the production of hydrocarbons (oil and gas), which are trapped in various zones in the subsurface formations at different depths. A first or uppermost section of the wellbore having a first diameter is drilled to a first depth and such a wellbore is lined with a casing (metal tubular) and cemented to stabilize the upper section of the earth subsurface. A second borehole of a diameter smaller than the first diameter is drilled to a second depth, lined with a casing and cemented. Additional wellbores of successive smaller diameters may also be drilled and lined in the same manner. Once a section is drilled, a liner (also refer referred to as tubular or pipe) is hung from the casing in the prior upper section. A commonly used liner includes a liner hanger on its outside that is set inside the casing to hang the liner in the wellbore. A packer placed above the liner hanger on the outside of the liner is then set to seal the annulus between the liner and the casing above the packer. A commonly used liner hanger is a hydraulically-set device that is in fluid communication with the inside of the service string via communication holes or fluid flow paths in the liner and the service string. A fluid under pressure is supplied to the inside of the service tool to hydraulically set such a liner hanger. The running tool is then disengaged from the inside of the liner and moved to mechanically set the packer. The holes in the liner often create leak paths between the liner and the casing or the formation, which degrade the liner hanger over time. It is therefore desirable to have liner hangers that avoid the use of such holes or fluid flow paths. It also is desirable to set liner hangers and other devices, such as packers, without supplying pressurized fluid from the surface or to manipulate the service string as such operations are time consuming and require using heavy equipment. It is also desirable to obtain information or confirmation that the liner hangers are fully set before releasing the running tools or setting the packers.

The disclosure herein provides apparatus and methods for remotely setting liner hangers without the use fluid flow paths or holes in the liners and other devices, including packers.

SUMMARY

In one aspect, a method of hanging a liner in a wellbore is disclosed that in one non-limiting embodiment includes: conveying a liner having a liner hanger and a liner hanger actuator into the wellbore by a service string that includes a controller that determines a downhole parameter of interest relating to setting of the liner hanger; determining by the controller the parameter of interest relating to setting of the liner hanger in the wellbore; and sending a wireless liner hanger command signal from the controller in response to the determined parameter of interest to cause the liner hanger actuator to set the liner hanger in the wellbore.

In another aspect, an apparatus for use in a wellbore is disclosed that in one non-limiting embodiment includes: a liner having a liner hanger and a liner hanger actuator to set the liner hanger in the wellbore; and a service string for placement in the liner that includes: a controller that (i) determines a downhole parameter of interest relating to setting of the liner hanger in the wellbore; and (ii) transmits a wireless liner hanger command signal to cause the liner hanger actuator to set the liner hanger in the well bore.

Examples of the more important features of the apparatus and methods disclosed herein are summarized rather broadly in order that the detailed description thereof that follows may be better understood, and in order that the contributions to the art may be appreciated. There are, of course, additional features that will be described hereinafter and which will form the subject of the claims.

BRIEF DESCRIPTION OF THE DRAWINGS

For a detailed understanding of the apparatus and methods disclosed herein, reference should be made to the accompanying drawings and the detailed description thereof, wherein like elements are generally given same numerals and wherein.

DETAILED DESCRIPTION OF THE DRAWINGS

Figure 1:
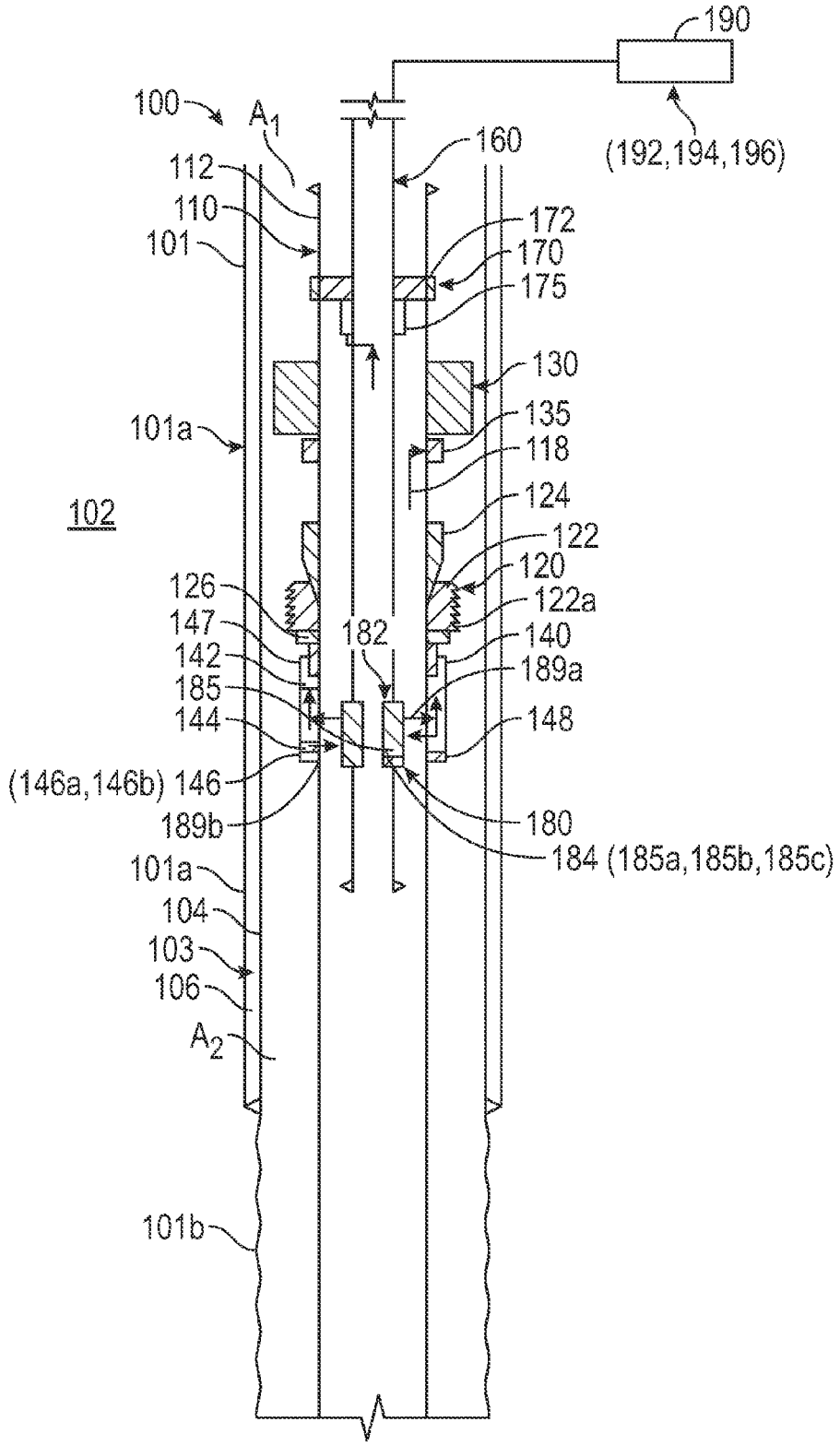
FIG. 1 shows a liner hanger system or apparatus including a liner placed in a wellbore by a running tool in a service string before hanging of the liner in the wellbore.

FIG. 1 shows a liner hanger system 100 (also referred to herein as liner hanger apparatus) according to one non-limiting embodiment of the present disclosure. The system 100 includes a liner 110 for hanging the liner inside a casing 104 in a wellbore 101 formed in a subsurface formation 102. The wellbore is shown to include an upper section 101*a* that has been cemented with cement 106 between the wellbore 101 and the casing 104 and a lower wellbore section 101*b* that is uncased, i.e., an open hole. The liner 110 includes pipe or tubular 112 that has a liner hanger 120 on the outside of the liner for hanging the liner 110 inside the casing 104. The liner hanger 120 may be any suitable or available device that may be set or activated hydraulically, mechanically, magnetically, electrically or by another suitable mechanism. In one non-limiting embodiment, the liner hanger 120 includes slips 122 that ride on a ramp 124 when a movable member, such as setting sleeve 126, is linearly moved against the slips 122 to cause the teeth 122*a* to engage with the inside 104*a* of the casing 104 to hang the liner 110 inside the casing 104. Thus, in such a liner hanger, linearly or axially moving a member associated with the liner hanger causes the liner hanger to set. Although, the liner hanger 120 is shown as a slip type, any other suitable liner hanger, including but not limited to, an expandable line hanger may be utilized. The liner 110 also is shown to include a packer 130 on the outside of the liner pipe 112 above the liner hanger 120. The packer 130 is set between the casing and the liner pipe 112 to seal an upper annulus A1 from a lower annulus A2 about the packer 130. The packer 130 may be any suitable or available device that may be set or activated hydraulically, mechanically, magnetically, electrically or by another suitable mechanism.

In a non-limiting embodiment, an actuator 140 (also referred to herein as the "liner hanger actuator") is coupled to the liner hanger 120 to set the liner hanger. In a non-limiting embodiment, the actuator 140 includes an actuation device 142 that is activated or triggered by a control circuit 144. In a non-limiting embodiment, the control circuit 144 includes a transducer 146 (a receiver and/or transmitter) that receives and/or sends wireless signals, including, but not limited to, acoustic signals, electromagnetic signals, and vibration signals. The actuation device 142, includes, but is not limited to, a hydraulic device that applies force on the setting sleeve 126, a linear motion device, such as a magneto-strictive or magnetic device in which a member coupled to the setting sleeve 126 moves linearly to move the setting sleeve 126, an electric motor that moves a member linearly to move the setting sleeve 126, and any other device that generates a force to set a device. In operation, a transducer 146*a* in the actuator 140 receives command signals wirelessly from a known source and an actuation circuit 146*b* in the actuator activates the actuation device 142 to set the liner hanger 120. The control circuit 144 also determined the actuation of the device 140 from a sensor 147 and thus the setting of the liner hanger 120 and transmits a wireless signal relating to the setting of the liner hanger 120. The circuit 144 may utilize a pressure sensor to determine the activation of a hydraulically-activated liner hanger, linear movement of a member in the activation device 142 that provide an indication of the setting of the liner hanger 120 or any other suitable sensor. The packer 130 may also include a remotely-controlled actuator 135 similar to the actuator 140 for setting the packer 130.

Still referring to FIG. 1, to set the liner 110 in the casing 104, a service assembly or string 160 is attached to the inside of the liner 110 by a running tool 170. The service string 160 is then run into the casing 104 to locate the liner hanger 120 at the desired location, such as shown in FIG. 1. In a non-limiting embodiment, the running tool 170 may include latching elements 172 that latch onto a device or member 115 in the liner 110. In one embodiment, the running tool 170 may be released from the liner 110 mechanically. In another embodiment, the running tool 170 may be released by an actuator 175 similar to the remotely-controlled actuator 140 described above.

Still referring to FIG. 1, the service string 160 further includes a control sub 180 that in one embodiment includes one or more sensors 182, a control circuit or controller 184 that may further include a processor 185*a* (such as microprocessor), a data storage device 185*b* (such as a solid state memory) and programmed instructions 185*c* accessible to the processor 185*a*, and a transducer 186 for receiving and transmitting signals wirelessly. The controller 184 also may communicate with the packer actuator 135 wirelessly as shown by arrow 118 or wirelessly. A power source 188, such as a battery, may provide power to the various components of the control sub 180. In another embodiment, a suitable line or link 118 in the service assembly 160 may be provided for providing power to the control sub 180 and for data communication between the control sub 180 and a surface controller 190. Controllers 184 and 190 may also communicate with each other wirelessly. Controller 190 may be a computer-based system that includes a processor, storage device and programs for controlling certain operations of the liner hanger system 100. The sensors 182 may include any sensor for providing information relating to a condition or parameter of interest relating to the setting the liner hanger 120, including, but not limited to, a vibration sensor, flow rate sensor, accelerometer, magnet, sensor for receiving electromagnetic waves from a known source, such as a source at the surface via the earth or a tubular in the system 110, and a sensor for receiving radio waves transmitted from a ball dropped inside the service assembly 160.

Figure 2:
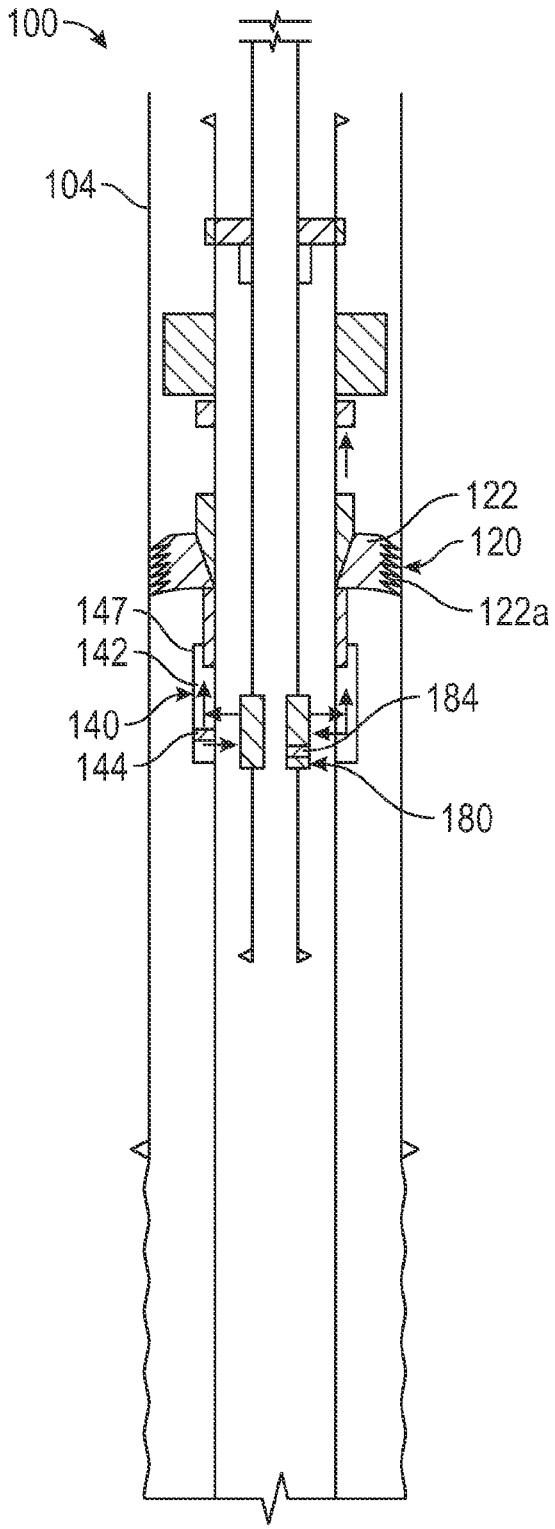
FIG. 2 shows the liner hanger system of FIG. 1 after a liner hanger on the liner has been set.

Referring to FIG. 2, to set the liner hanger 120 in the casing 104, the controller 184 in the control sub 180 transmits a wireless command signal (arrow 189*a*) (also referred to as the liner hanger command signal) to the controller 144 of the liner hanger actuator 140. The controller 144 activates the actuation device 142, which applies a force on the setting sleeve 126, which moves the slips 122 to cause the teeth 122*a* to bite into the casing 104 to set the liner hanger 120 in the casing 104, as shown in FIG. 2. The controller 144 determines from the sensor 147 in the liner hanger actuator 140 the setting of the liner hanger 120 and sends a signal (arrow 189*b*) confirming the setting of the liner hanger 120 and/or sends a measurement signal relating to the setting of the liner hanger 120 from which the controller 184 determines whether the line hanger 120 has been set. If the liner hanger 120 has not been set, an operator may take a remedial action. If the liner hanger 120 has been set, in one non-limiting embodiment, the controller 184 transmits a command signal to the running tool actuator 175 to release the running tool 170 from the liner 110. The actuator 175 then releases the running tool 170 and the service tool 160 is ready for movement inside the liner 110, as shown in FIG. 3.

Figure 3:
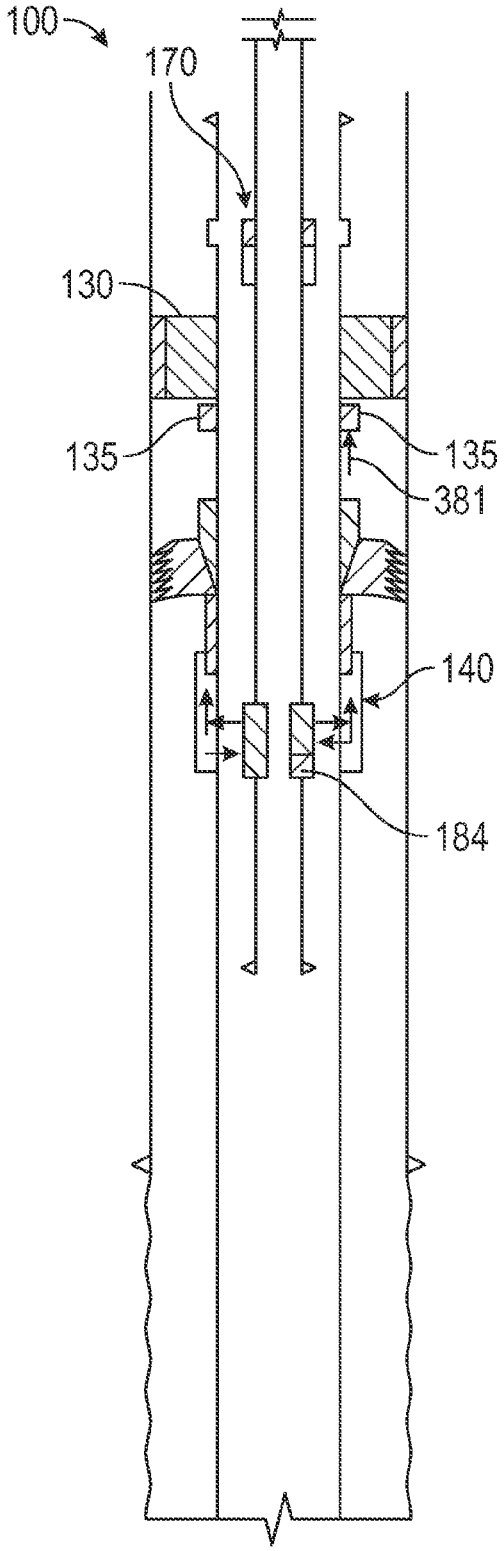
FIG. 3 shows the liner hanger system of FIG. 2 after a running tool in the service string has been released and a packer on the liner has been set in the wellbore.

Referring to FIG. 3, if the packer 130 is a mechanically-set packer, the running tool 170 is moved to set a weight on the packer 130 to set the packer, as is known in the art. If the packer 130 includes a packer actuator 135, as described earlier in reference to FIG. 1, the controller 184 sends a wireless command signal (also referred to as the packer command signal) 381 to the packer actuator 135, which sets the packer 130 in the casing 104, as shown in FIG. 3. Alternatively, if the packer 130 includes an actuator 135, the packer 130 may be set after the liner hanger 120 has been set and before the running tool 170 is released. The running tool 170 may then be released after the packer 130 has been set. FIG. 3 shows the running tool 170 released from the liner 110, the liner hanger 120 and the packers as set. The service string 160 may then be retrieved from the casing 104.

Thus, a liner hanger system or apparatus, according to one non-limiting embodiment, includes an electronic sub (or e-sub) in a service string that includes one or more sensors and a controller or circuit for determining a parameter or condition of interest relating to the setting of a liner hanger to set or hang a liner in a casing in the wellbore. The controller is carried by a service string or assembly placed inside the liner. The service string includes a running tool that is releasably engaged to the inside of the liner. A liner hanger on the liner includes a remotely-activated (electronically-activated) liner hanger actuator or setting device that sets or activates the liner hanger in response to a wireless signal received from the controller in the electronic sub. The sensors in the electronic sub may include, but are not limited to, vibration sensors, flow rate sensors, accelerometers, magnets, electromagnetic wave receivers for receiving signals from a surface location through the earth subsurface or through a tubular of the system, radio wave receivers for receiving a signals transmitted from a ball dropped inside the service string, and wiper plugs. The signal transmitted by the electronic sub may include, but is not limited to, an acoustic short hop signal, an electromagnetic signal, vibration signal, and Inductive signal. When the liner hanger has been set, the liner hanger actuator transmits a confirmation signal to the electronic-sub, which records such information and transmits a signal via a link (such as a conductor or optical fiber) in the service string or wirelessly to a running tool actuator to release the running tool. The running tool may then be pulled out of the liner hanger assembly and if the packer is mechanically set packer the running tool may be utilized to mechanically set the packer above the liner hanger. In one embodiment, the running tool includes lugs that set weight on the packer to set the packer inside the casing. In another embodiment, the packer includes a packer actuator that receives wireless command signals from the controller and sets the packer. In such a case, the packer may be set before releasing the running tool. In the liner hanger system, the electronic sub may record data relating to setting of the liner hanger, packer and the running tool for real time use or later analysis by a surface controller. The data may also include information relating to downhole pressure, torque, weight, and flow rates. Such a system avoids the use of holes in the liner to hydraulically set the liner hangers, as is commonly performed in the current systems, which holes are prone to leaks and thus degrade the liner hanger over time. In one embodiment, the devices to set the liner hanger, release the running tool and/or to set the packer may include an external spring or an atmospheric chamber independent of the liner hanger mandrel to provide a setting force relative to hydrostatic to linearly or axially move a member to set such devices.

The foregoing disclosure is directed to certain exemplary embodiments and methods. Various modifications will be apparent to those skilled in the art. It is intended that all such modifications within the scope of the appended claims be embraced by the foregoing disclosure. The words "comprising" and "comprises" as used in the claims are to be interpreted to mean "including but not limited to". Also, the abstract is not to be used to limit the scope of the claims.

The invention claimed is:

1. A method of hanging a liner in a wellbore, the method comprising:

providing a liner hanger and a liner hanger actuator on the liner;

conveying the liner into the wellbore by a service string, the service string including a controller that determines a downhole parameter of interest relating to setting of the liner hanger;

determining by the controller the parameter of interest relating to setting of the liner hanger in the wellbore; and sending a wireless liner hanger command signal from the controller to the liner hanger actuator in response to the determined parameter of interest to cause the liner hanger actuator to set the liner hanger in the wellbore.

2. The method of claim 1 further comprising:

(i) determining setting of the liner hanger in the wellbore from a sensor measurement associated with the liner hanger actuator; and (ii) sending by the liner hanger actuator a wireless signal relating to the determined setting of the liner hanger.

3. The method of claim 2, wherein the service string includes a running tool attached to the liner and a running tool actuator, the method further comprising sending by the controller a running tool command signal after the setting of the liner hanger to cause the running tool actuator to release the running tool from the liner.

4. The method of claim 2, wherein the liner includes a packer and the service string includes a mechanically-releasable running tool attached to the liner for conveying the liner into the wellbore, wherein the method further comprises: releasing the running tool from the liner after the setting of the liner hanger; and moving the running tool to set the packer.

5. The method of claim 1, wherein the liner further includes a packer and a packer actuator, the method further comprising sending a wireless packer command signal from the controller after the setting of the liner hanger in the wellbore to cause the packer actuator to set the packer in the wellbore.

6. The method of claim 5, wherein the service string further includes a releasable running tool attached to the liner and wherein the setting of the packer is performed before releasing the running tool from the liner.

7. The method of claim 1, wherein the parameter of interest is selected from a group consisting of: (i) vibration; (ii) flow rate; (iii) acceleration; (iv) magnetic field pick-up; reception of an electromagnetic wave; (v) reception of a radio wave; (vi) detection of a device dropped into the service string; and (vii) detection of a wiper plug.

8. The method of claim 1, wherein the liner hanger command signal is selected from a group consisting of: (i) an acoustic signal; (ii) an electromagnetic signal; (iii) an inductive signal; and (iv) a vibration signal.

9. An apparatus for use in a wellbore, comprising:

a liner, a liner hanger on the liner and a liner hanger actuator on the liner, wherein the liner hanger actuator is configured to set the liner hanger in the wellbore; and a service string for placement in the liner, the service string including:

a controller that (i) determines a downhole parameter of interest relating to setting ofthe liner hanger in the wellbore and (ii) transmits a wireless liner hanger command signal to the liner hanger actuator in response to the downhole parameter of interest to cause the liner hanger actuator to set the liner hanger in the wellbore.

10. The apparatus of claim 9, wherein the liner hanger actuator includes an actuation device that is selected from a group consisting of: a hydraulic force application device; (ii) a linear motor; (iii) and an electric motor; (iv) an external spring; and (v) an atmospheric chamber independent of the liner hanger to provide a setting force relative to hydrostatic.

11. The apparatus of claim 9, wherein the parameter of interest is selected from a group consisting of: (i) vibration; (ii) flow rate; (iii) acceleration; (iv) magnetic field pick-up; (v) reception of an electromagnetic wave from a known source; (vi) reception of a radio wave from a known source; and (vii) detection of a known device moving in the service string.

12. The apparatus of claim 9, wherein the liner hanger actuator includes: a sensor that provides a measurement relating to the setting of the liner hanger; and a circuit that transmits a wireless signal to the controller responsive to the sensor measurement.

13. The apparatus of claim 12, wherein the sensor is selected from a group consisting of: (i) a pressure sensor; and (ii) a linear motion detection sensor.

14. The apparatus of claim 9, wherein the service string includes a releasable running tool attachable to the liner and wherein the controller sends a command signal to the running tool actuator after the liner hanger has been set to release the running tool from the liner.

15. The apparatus of claim 9, wherein the liner further includes a packer and a packer actuator and wherein the controller sends a packer command signal after the setting of the liner hanger in the wellbore to the packer actuator to set the packer.

16. The apparatus of claim 9, wherein the controller sends wireless command signals selected from a group consisting of: (i) an acoustic signal; (ii) an electromagnetic signal; (iii) an inductive signal; and (iv) a vibration signal.

17. The apparatus of claim 9, wherein the service string includes a running tool attachable to the liner for conveying the liner into the wellbore that is mechanically releasable from the liner.

18. The apparatus of claim 17 further comprising a packer on the liner that is configured to be set by the running tool.

* * * * *